US008112926B2

(12) United States Patent
Gussalli Beretta

(10) Patent No.: US 8,112,926 B2
(45) Date of Patent: Feb. 14, 2012

(54) REVERSIBLE STOP HOOK FOR A GUN MAGAZINE AND KIT FOR A GUN

(75) Inventor: Ugo Gussalli Beretta, Brescia (IT)

(73) Assignee: Fabbrica d'Armi Pietro Beretta S.p.A., Brescia (IT)

( * ) Notice: Subject to any disclaimer, the term of this patent is extended or adjusted under 35 U.S.C. 154(b) by 1268 days.

(21) Appl. No.: 11/260,380

(22) Filed: Oct. 28, 2005

(65) Prior Publication Data

US 2006/0096145 A1 May 11, 2006

(30) Foreign Application Priority Data

Nov. 11, 2004 (IT) ..... MI2004A2165

(51) Int. Cl.
*F41A 9/61* (2006.01)

(52) U.S. Cl. ..... 42/7; 42/6

(58) Field of Classification Search ..... 42/6, 7; 403/289, 290; 248/311.3
See application file for complete search history.

(56) References Cited

U.S. PATENT DOCUMENTS 1,397,109 A * 11/1921 Pedersen ..... 42/7
4,236,337 A 12/1980 Beretta
4,449,311 A 5/1984 Giragosian
4,521,985 A * 6/1985 Smith et al. ..... 42/7
4,539,770 A * 9/1985 Bornancini ..... 42/7
4,573,280 A 3/1986 Malhotra
4,599,818 A 7/1986 Fedora et al.
4,899,476 A * 2/1990 Hindle ..... 42/7
5,058,301 A * 10/1991 Lishness et al. ..... 42/7
5,143,500 A * 9/1992 Schuring et al. ..... 411/339
5,400,461 A * 3/1995 Malish et al. ..... 15/230.17
5,519,954 A * 5/1996 Garrett ..... 42/6
5,619,770 A * 4/1997 Bell ..... 15/230.17
5,647,107 A * 7/1997 Brewster ..... 24/713.6
6,112,446 A 9/2000 Förster et al.
6,141,895 A 11/2000 Rost et al.
6,345,946 B1 * 2/2002 Mainini et al. ..... 411/508

OTHER PUBLICATIONS

Wilson Combat Extended Magazine Release (http://www.wilsoncombat.com/a_magazine_releases_ext.asp) Feb. 20, 2004, date has been verified using www.waybackmachine.org.*

BCG Mag Release Button, BCG-Cyclone; www.1911store.com; Feb. 7, 2003; date verified at http://web.archive.org/web/*/http://www.1911store.com/ and http://web.archive.org/web/20030207102432/http://www.1911store.com/ and http://web.archive.org/web/20030209231029/www.1911store.com/product.asp?3=22.*

(Continued)

*Primary Examiner* — Gabriel Klein
(74) *Attorney, Agent, or Firm* — Hogan Lovells US LLP

(57) ABSTRACT

A reversible stop hook (26) for a magazine (16) of a gun (10) is adapted to be housed in the gun transversally to the magazine to be locked and comprises a coupling portion (28) being provided with a button-shaped end (30) and a stop end (32) for the magazine. The coupling element comprises at least a first component (42) and a second component (40) partially inserted one inside the other along a longitudinal direction of the stop hook. The first component (42) comprises a coupling portion (50) which is either deformable or yielding, in order to mutually fasten the first and second components along the longitudinal direction. A third component (60) is inserted into the coupling portion (50) of the first component (42) in order to prevent the first and second components from mutually unfastening.

24 Claims, 4 Drawing Sheets

OTHER PUBLICATIONS

Mirriam-Webster's Online Dictionary. Aug. 3, 2010. <http://www.merriam-webster.com/dictionary/fasten>.*

European Search Report, Jan. 31, 2006, European Patent Application No. EP 05 42 5707.

* cited by examiner

REVERSIBLE STOP HOOK FOR A GUN MAGAZINE AND KIT FOR A GUN

FIELD OF THE INVENTION

The objects of the present invention are a reversible stop hook for a gun magazine and a kit for a gun.

BACKGROUND OF THE INVENTION

In the weapon field, particularly the one of the guns, it is known to provide a stop hook adapted to be housed in the gun transversally to the magazine to be locked.

Stop hooks of the reversible type are also known, i.e. which can be used both by a right-handed shooter and a left-handed shooter. In a known example of a stop hook of the reversible type, it is provided that the hook can be inserted into the gun by arranging one button-shaped end thereof either on the right or the left side of the same gun as a function of the shooter's requirements. In other words, the (right or left) setting of the gun can be changed by extracting the stop hook from the gun, then rotating it by 180° and then inserting it again into the housing thereof inside the gun. A reversible hook is for example described in U.S. Pat. No. 4,236,337.

The known stop hooks have some drawbacks; for example, the reversibility is achieved by a structure that is somewhat complex, which requires expensive materials and processing and causes complications to the user in the assembling and disassembling step of the hook on the gun.

In fact, with reference to the stop hooks of the type described above, the need for being able to assemble and disassemble them easily and intuitively, preferably directly on the gun, having at disposal in any case a hook being effective and reliable in holding the magazine in the housing thereof, is deeply felt in the field.

A further need for personalizing some weapon details so as to make the use thereof easier is deeply felt in the field.

Therefore, the problem at the heart of the present invention is to provide a reversible stop hook for a gun magazine which has such structural and functional characteristics as to meet said requirements while overcoming the drawbacks mentioned above with reference to the prior art.

SUMMARY OF THE INVENTION

This problem is solved by means of a reversible stop hook for a gun magazine in accordance with claim 1. Further embodiments are the object of the dependent claims.

BRIEF DESCRIPTION OF THE DRAWINGS

Further characteristics and the advantages of the stop hook for a gun magazine according to the invention will be understood from the description of preferred exemplary embodiments as set forth herein below, which are given by way of indicative and non-limiting example, with reference to the annexed figures, in which.

DETAILED DESCRIPTION OF THE INVENTION

Figure 1:
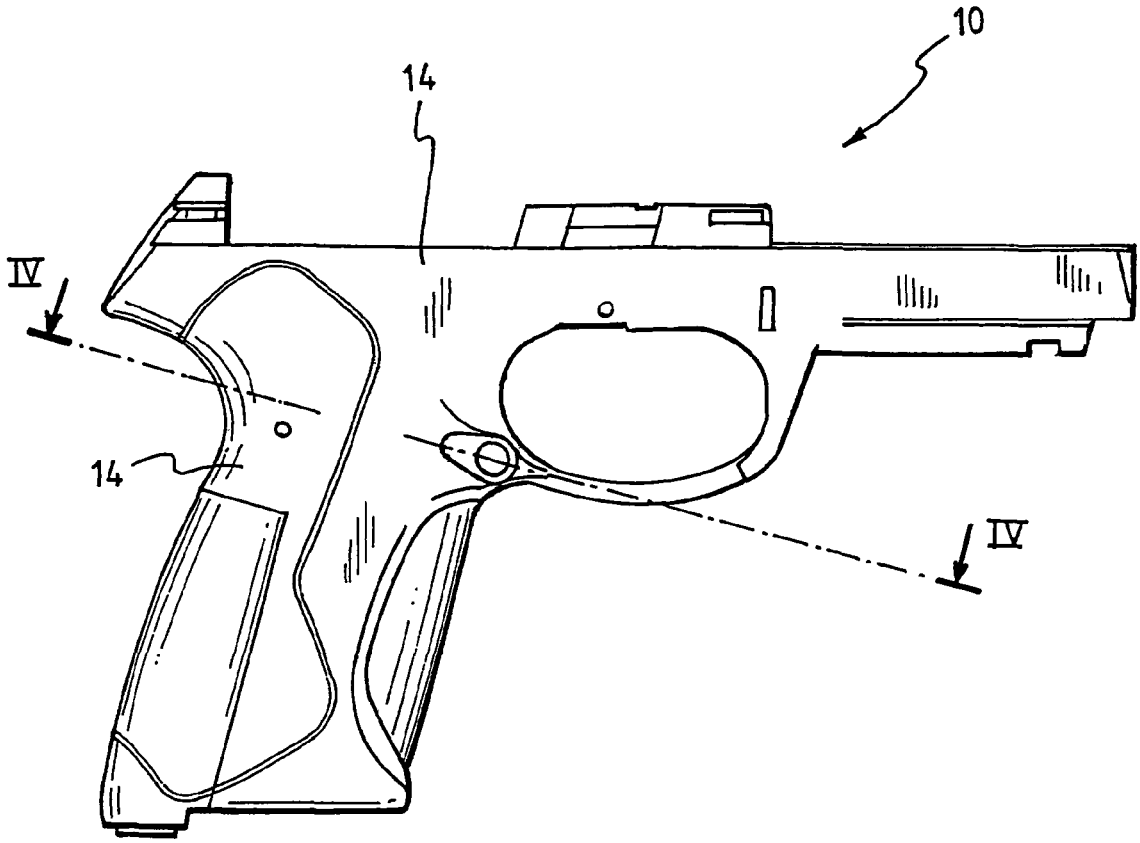
FIG. 1 shows a side view of a gun frame comprising a stop hook for a magazine according to the present invention.
Figure 2:
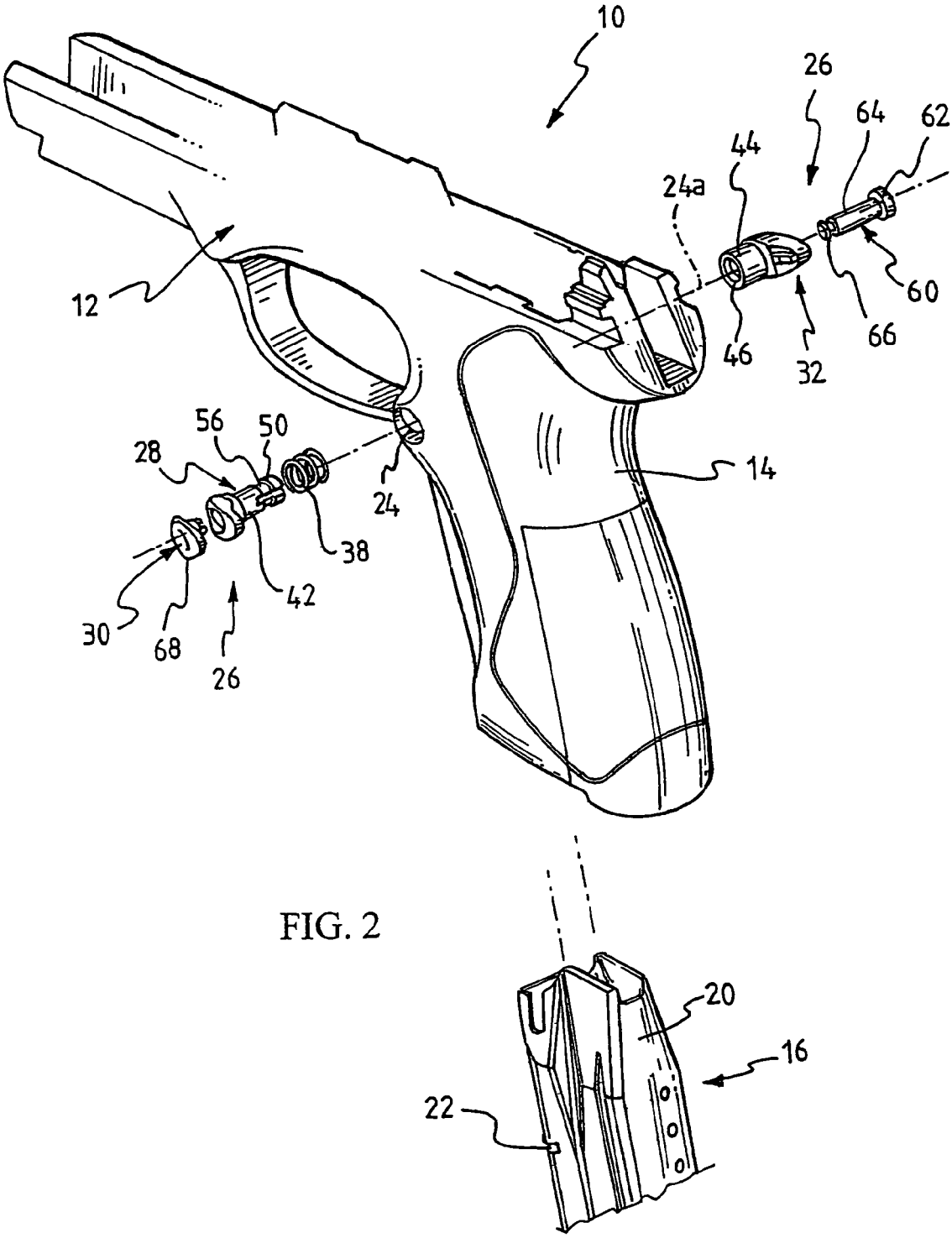
FIG. 2 shows a cut-away perspective view of a gun comprising a stop hook for a magazine according to the present invention.

With reference to said figures, a gun as a whole comprising a frame 12 expanding in a grip 14 has been indicated with 10.

A magazine adapted to be accommodated in a housing 18 within the grip through a lower aperture has been indicated with 16. The magazine 16 comprises a box 20 extending along the housing 18 and grip 14. In accordance with a possible embodiment, notches for example located in the opposite sides of the box have been indicated with 22.

A housing 24 is located transversally to the magazine and the box thereof and passes through the grip 14, for example in a front area of the same grip. The housing 24 extends along a longitudinal direction 24*a* located transversally to the magazine.

A reversible stop hook as a whole adapted to be slidingly housed in the housing 24, transversally to the magazine 16 to be locked or more precisely to the box 20 thereof has been indicated with 26.

In accordance with a possible embodiment, the stop hook 26 comprises a coupling element 28 extending along the housing 24. The coupling element 28 comprises a button-shaped end 30 and a stop end 32 for the magazine.

According to a possible embodiment, the coupling element 28 is U-shaped with a central length expanding along the longitudinal direction of the housing 24. The button-shaped end 30 and the stop end 32 define the U arms.

In accordance with a possible embodiment, the stop end 32 is shaped so as to lock the magazine 16 within the housing 18, thus defining a constraint on the extraction of the magazine from the grip. Advantageously, the stop end 32 comprises at least one tooth 36 adapted to be inserted into a corresponding notch 22 of the box 20 of the magazine 16. In other words, the configuration of the stop end 32 of the coupling element 28 is such to be coupled with the magazine box.

In accordance with a possible embodiment, elastic means, preferably a helical spring, being accommodated on the coupling element 28 and interposed between the button-shaped end 30 and a strike 40 inside the housing 24 have been indicated with 38. The elastic means are adapted to keep the button-shaped end 30 away from the strike 40 and thus the stop end 32 in an interference position with the magazine.

According to a possible embodiment, a first component of the coupling element 28 has been indicated with 42 and a second component of the coupling element 28 has been indicated with 44.

Advantageously, the first component 42 comprises the button-shaped end 30 and the second component 44 comprises the stop end 32 for the magazine 16.

The first and second components are partially inserted one inside the other along the longitudinal direction of the stop hook. Advantageously, the first component is partially inserted into the second component. In other words, in accordance with a possible embodiment, the second component 44 is provided with a housing 46 adapted to partially accommodate the first component 42. Advantageously, the housing 46 extends along the longitudinal direction of the stop hook and is open to the inside of the housing 24 in order to accommodate the first component. Preferably, the housing 46 extends along the whole second component 44 also opening to the outside of the stop hook.

In accordance with a possible embodiment, a cross rib 48 extends to the inside of the housing 46. In the case where the housing 46 has a substantially cylindrical shape such as illustrated in the figures, the cross rib 48 is an annular rib. Preferably, the cross rib is located either at an area inside the housing 46, or at an end opening to the stop end 32.

Preferably, the cross rib 48 is defined on either side by respective cross surfaces 48*a*.

According to a possible embodiment, the first component 42 comprises a coupling portion 50 with the second component 44. With reference to the embodiment shown in the figures, the housing 46 of the second component 44 is adapted to accommodate the coupling portion 50 of the first component 42, inserted along the longitudinal direction of the stop hook.

According to a possible embodiment, the coupling portion 50 is provided with at least one longitudinal notch 52, preferably a plurality of longitudinal notches 52 defining at least a longitudinal tongue 54. In the shown embodiment, there are provided four longitudinal notches 52 and four respective longitudinal tongues 54.

In accordance with a possible embodiment, the coupling portion 50 is provided with a cross groove 56. In the case where the first component is partially inserted into the second component, the cross rib 56 is for example provided in the outer surface of the coupling portion 50 and is adapted to accommodate the cross rib 48 of the second component.

In the case where the coupling portion 50 has a substantially cylindrical shape such as illustrated in the figures, the cross groove 56 is an annular groove. Preferably, the cross rib is located either at one area inside the housing 46, or at an end opening to the stop end. Preferably, the cross groove 56 is defined on either side by respective cross surfaces 56*a*.

In the case where the coupling portion 50 comprises one or more longitudinal notches 52, the cross groove 56 is arranged along the area including these longitudinal notches. In other words, the cross groove 56 is interrupted by the longitudinal notches 52.

According to a possible embodiment, the coupling portion 50 is provided with a cavity 58 extending along the longitudinal direction of the stop hook. Advantageously, such as shown, for example, in FIGS. 3-5, the cavity 58 extends along the whole first component 42 opening both to the inside and the outside of the stop hook. Alternatively, such as for the embodiment from FIG. 6, the cavity 58 extends for a length of the first component 42 and is open only to the inside of the stop hook.

In accordance with a possible embodiment, the coupling element 28 further comprises a third component 60. With reference to the embodiment shown in FIGS. 3-5, in which the first component is hollow and inserted into the second component, the third component 60 is inserted at least internally in the coupling portion 50 of the first component 42, in order to prevent the first and second components from mutually unfastening. In other words, in accordance with a possible embodiment, the coupling element 28 comprises the third component 60 being inserted into the first component 42, particularly into the coupling portion 50 thereof which is, in turn, inserted into the second component 44. The three components of the coupling element 28 are coaxial to one another along the longitudinal direction of the same coupling element.

In accordance with the embodiment shown in the figures, in which the housing 46 of the second component 44 extends along the longitudinal direction of the second component until it opens to the outside of the stop hook, the third component 60 is inserted from the side of the second component along the longitudinal direction of the stop hook.

Preferably, the third component 60 comprises a head 62 being made integral with a peg 64 extending along the longitudinal direction of the stop hook and is provided with a portion axially located at the coupling portion 50.

In accordance with a possible embodiment, the head 62 integrates into the end of the second component, i.e. the stop end 32. Preferably, the head 62 is completely inserted into the housing 46.

Figures 3, 4:
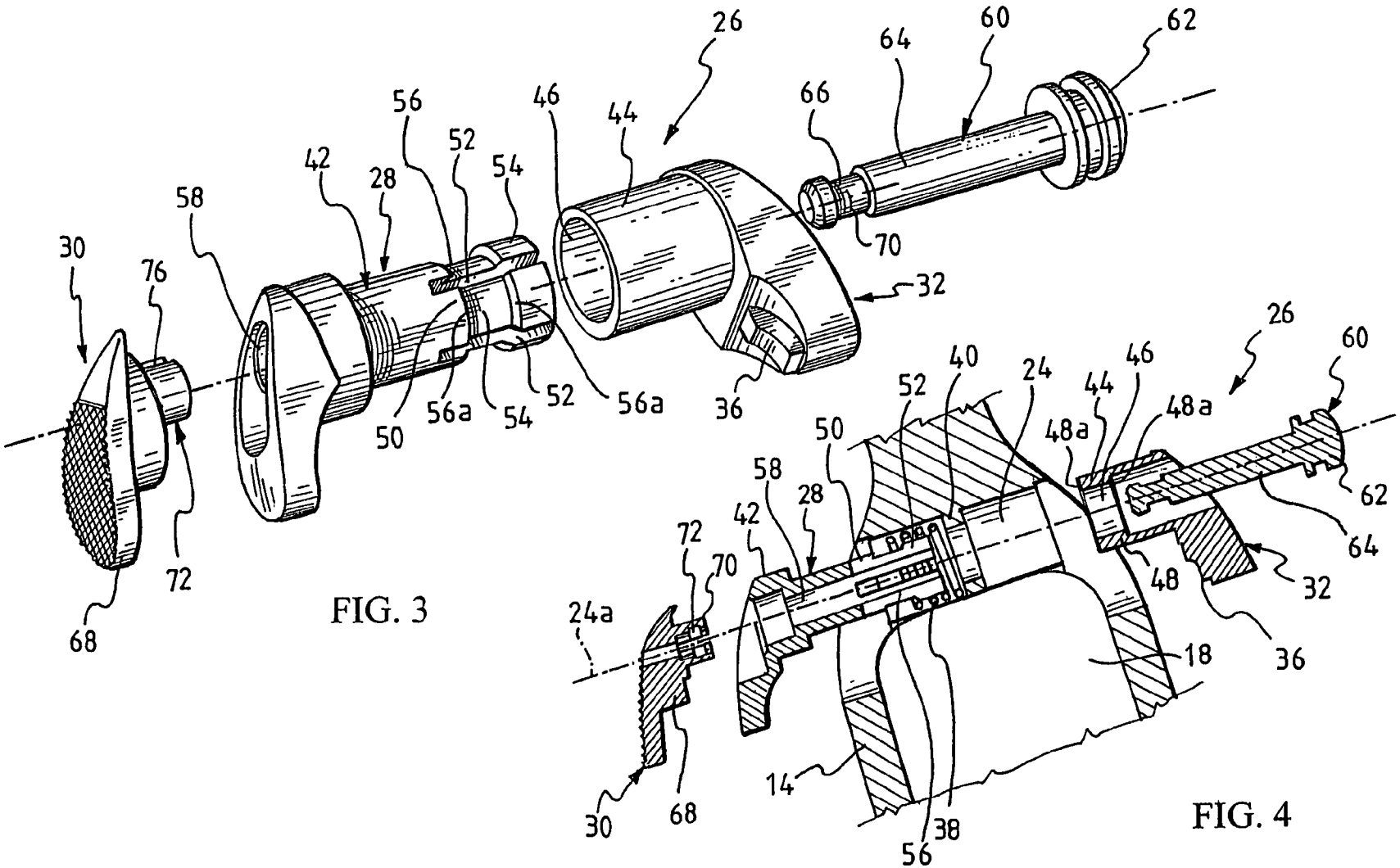
FIG. 3 shows an enlarged cut-away perspective view of the stop hook illustrated in FIG. 1.
FIG. 4 shows a sectional view along line IV-IV from FIG. 1 in which the gun frame is partially illustrated and in which the stop hook is shown in a cut-away manner.
Figure 5:
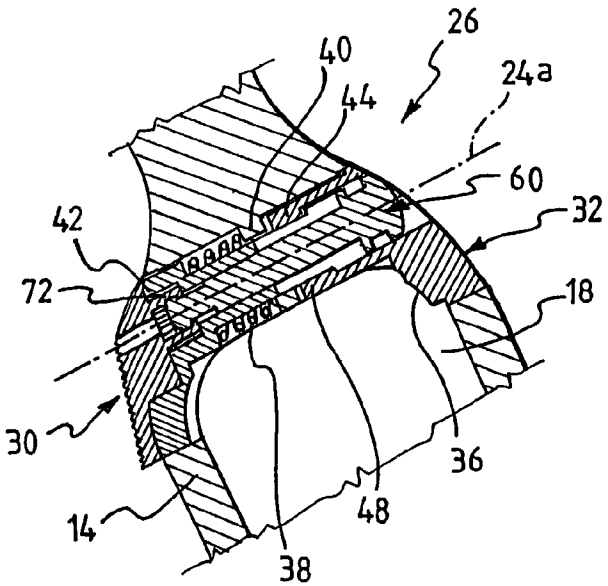
FIG. 5 shows a sectional view along line IV-IV from FIG. 1 in which the gun frame is partially illustrated and in which the stop hook is shown in an assembled manner.

In accordance with an embodiment such as shown, for example, in FIGS. 3-5, the cavity 58 of the first component 42 extends until it opens to the outside of the stop hook and the housing 46 of the second component 44 extends from the opposite side until it opens to the outside of the stop hook. Advantageously, the third element 60 comprises a head 62 and a peg 64 which internally passes through the first component and the second component and comprises a coupling end 66 with an appendix 68, which is opposite to the head 62.

Advantageously, the coupling end 66 of the peg 64 is provided with a cross groove 70 and the appendix 68 comprises a tubular extension 72 with a cross rib 74 adapted to be accommodated in the cross groove 70. Preferably, the tubular extension 72 comprises one or more longitudinal notches 76.

In accordance with a possible embodiment such as shown, for example, in FIGS. 3-5, the appendix 68 integrates the button-shaped end 30 of the first component 42. In other words, the cavity 58 of the first component extends in order to accommodate the appendix 68 and forms the button-shaped end. Advantageously, the appendix 68 externally covers the first component.

According to a possible embodiment, the appendix 68 is adapted to form the outer surface of the button-shaped end 32 on which the shooter acts in order to release the magazine. Preferably, the appendix 68 has a shape, size, surface materials and finishing adapted to form an ergonomic button for the shooter.

According to a general aspect of the invention, the first component and the second component are partially inserted one inside the other along the longitudinal direction of the stop hook and the coupling portion of the first component is either deformable or yielding, in order to mutually fasten the first and second components at least along the longitudinal direction. With reference to the described and shown embodiment, the coupling portion 50 is either deformable or yielding due to the presence of the longitudinal notches and longitudinal tongues which can bend to the inside of the cavity 58 while the coupling portion 50 is being inserted into the second component in order to pass the cross rib 48.

In other words, the coupling portion of the first component is either elastically deformable or yielding while the first and second components are being mutually inserted in order to pass and set in a mutual abutment constraint elements on the relative motion in the longitudinal direction of the first and second components. These constraint elements consist for example of the cross rib 48 and cross groove 56, even if other embodiments can be provided. In fact, while the coupling portion 50 is being inserted into the second component 44 along the longitudinal direction, the longitudinal tongues 54 bend in order to pass the cross rib 48 and then regain the elastic deformation when the cross rib 48 is accommodated in the cross groove 56. The mutual cross surfaces 48*a* and 56*a* provide a constraint on the relative motions of the first and second components along the longitudinal direction 24*a*.

Advantageously, there is provided a shape coupling between the coupling portion 50 and the second component 44 and, with reference to the shown embodiment, this shape coupling is defined by the mutual coupling between the cross groove 56 and the cross rib 48.

According to a general aspect of the invention, the third component defines a constraint for the coupling portion which is either deformable or yielding. In other words, with reference to the shown embodiment, the third element defines either a constraint or a hindrance element on the deformation of the coupling portion 50 in the opposite direction to the inserting one of the coupling portion into the second component.

Considering the shown embodiment of the coupling portion 50, the longitudinal tongues 54 bend while the coupling portion is being inserted into the second component and elastically return in the undeformed position in order to carry out the shape coupling between the first and second components. The inserting of the third component prevents the longitudinal tongues from either being deformed or bent to the inside of the housing, subsequent to opposite tensile forces on the first and second components.

In accordance with a possible embodiment, the present invention further relates to a kit for a gun comprising a reversible stop hook 26 for a magazine 16 according to one of the embodiments described above. The kit further comprises at least one further button-shaped end adapted to replace the one of the stop hook. Preferably, there is provided a plurality of further button-shaped ends which can be selected in order to personalize the weapon as a function of the shooter's requirements. The button-shaped ends vary in shape and/or sizes and/or materials and/or surface finishing.

Figure 6:
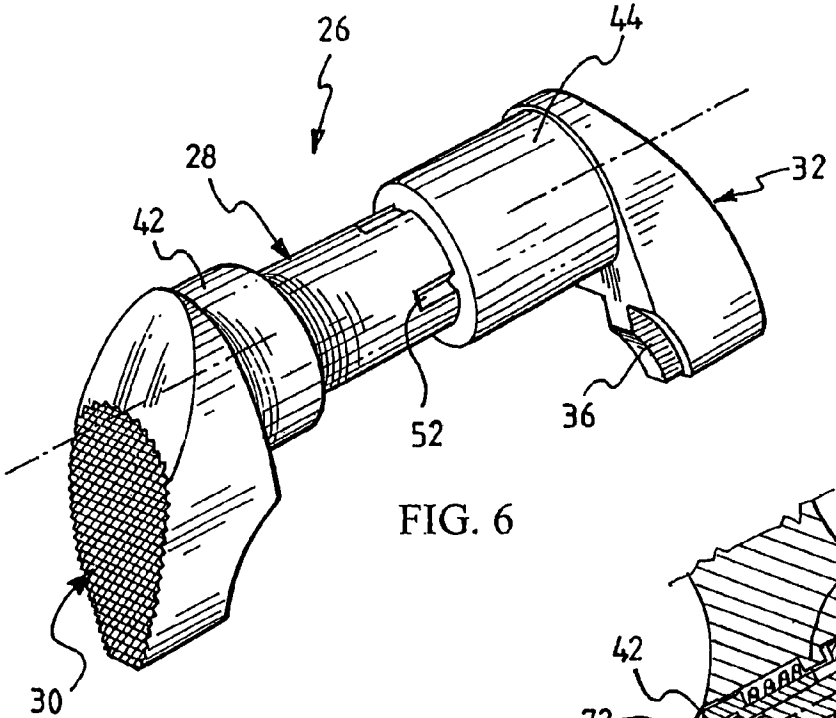
FIG. 6 shows an enlarged perspective view of the assembled stop hook, in accordance with a possible variant of embodiment.

In accordance with the embodiment shown in FIG. 6, the button-shaped end is made integral with the first component. Therefore, the kit according to the invention provides at least one further first component integrating at least one further button-shaped end. Preferably, there is provided a plurality of further first components, their respective button-shaped ends may vary in shape and/or sizes and/or materials and/or surface finishing.

In accordance with a different embodiment, the button-shaped end comprises an appendix 68 which is removable relative to the first component. In this case, the kit comprises at least one further removable appendix adapted to replace the removable appendix of the first component. Advantageously, each button-shaped end comprises fastening means either with the appendix or the further appendix.

In accordance with a possible embodiment, a third element of the stop hook comprises a coupling end with the appendix 68. Alternatively, the removable appendix is a head of the third element of the stop hook.

Figure 7:
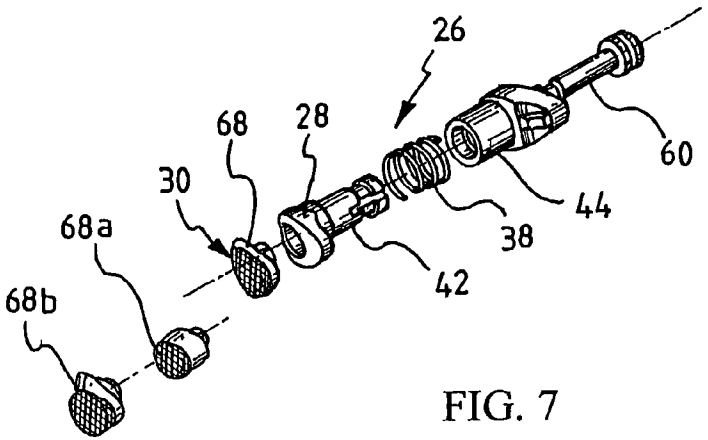
FIG. 7 shows an enlarged perspective view of a portion of a kit according to the present invention.

FIG. 6 and FIG. 3 show not only two different embodiments for the kit described above but also two possible configurations of the button-shaped end. Moreover, FIG. 7 shows a kit comprising three appendices which have been indicated with 68, 68*a*, and 68*b*, respectively. The same embodiments may be applied in the case where the appendix is made integral with the first component thus providing three different button-shaped ends.

It will be described herein below the mode of assembling and use for the stop hook for a magazine described above, with reference to the shown embodiment.

The annexed figures show the stop hook being preset for being used by a right-handed shooter. In fact, the button-shaped end is situated on the gun left side in order to be pressed by means of the shooter's right thumb.

The assembling of the stop hook is directly carried out in the housing 24 of the gun, by acting along the longitudinal direction of the same housing and stop hook.

The first component 42 is inserted from the gun left side into the housing 24. The elastic means 38 are located around the first component.

The second component 44 in inserted from the gun right side into the housing 24.

By approaching the first and second components along the longitudinal direction within the housing 24, the coupling portion 50 of the first component 42 is inserted into the housing 46 of the second component 44. During insertion, the longitudinal tongues 54 meet the cross rib 48 and bend by elastically deforming and caving in to the inside of the cavity 58. When the cross rib 48 is at the level of the cross groove 56, the longitudinal tongues 54 are free to elastically return in the undeformed position. The cross rib 48 is set into the cross groove 56 and its respective cross surfaces 56*a* and 48*a* define a constraint on the mutual translation of the first and second components along the longitudinal direction.

Then the third component 60 is inserted into the housing 46 and the cavity 58 from the side of the second component 44. A portion of the peg 64 is set at the coupling portion thus providing a constraint for the longitudinal tongues, so as to prevent the bending thereof to the inside.

The shooter can personalize the weapon by presetting either a button-shaped end or an appendix selected between the ones available in the kit. As a function of the embodiment, it will be sufficient to replace the appendix 68 which can be directly mounted either on the first component or the third component. Alternatively, the entire first component comprising the button-shaped end integral can be replaced.

The assembled stop hook operation mode is substantially conventional. In fact, the elastic means affect the coupling element by moving away the button-shaped end from the strike 40 of the housing 24 and thus hold the tooth 36 inserted into the corresponding notch 22 of the box 20.

By exerting a pressure on the button-shaped end, the elastic means are compressed and the coupling element is translated along the housing 24 in order to release the magazine.

From what has been stated above, it should be appreciated that the fact of providing a stop hook for a magazine according to the present invention allows to meet said need for having a reversible hook, which is easy to be assembled by the user and reliable.

The described advantageous configuration allows an assembling directly within the housing in the gun, thus acting along the longitudinal direction and without entailing rotary motions among the parts.

A further advantage of the stop hook according to the invention is the unusual structural simplicity of the latter, which allows the latter to be manufactured with a very low cost. For example, the single components can be advantageously provided by moulding.

The presence of the third component allows to make the connection between the first and second components sure and reliable, thus avoiding the provision of high strength and elasticity characteristics for the material of the deformable coupling portion. In other words, either the deformability or yielding of the coupling portion allows the two components to be mutually inserted whereas the reliability of the seal is ensured by the third component which prevents the coupling portion from being released. Consequently, the material with which the stop hook is manufactured is not required to be selected as a function of the elastic and strength characteristics of the coupling between the first and second components.

It is understood that variants and/or additions to what has been described and shown above can be provided.

Alternatively to what is shown in the annexed figures, the coupling portion of the first component may be externally inserted onto the second component. Alternatively, the coupling portion can be provided in the second component comprising the magazine stop end.

In both cases, the cross rib and the cross groove can be provided either on the first or second component. Alternatively, in both cases, different shape couplings can be provided.

Alternatively to what is shown in the figures, the third component can be inserted from the side of the first component along the longitudinal direction of the stop hook. The cavity 58 of the first component extends along the longitudinal direction of the first component until it opens to the outside of the stop hook in order to accommodate the third component. The button-shaped end is thus defined by the head of the third component which integrates into the button end of the first component. In the case where the appendix of the third component is provided, this appendix can integrate into the stop end of the second component.

The third component may have shape and sizes which are different from the ones shown. For example, both the head and the appendix can be removably mounted on the peg. Otherwise, in the case where the coupling portion is outside, the third component may have a tubular shape.

In accordance with a possible embodiment, the peg 64 of the third component internally passes through the first component and the second component and an end which is opposite to the head does not open to the outside of the stop hook. Optionally, the peg comprises a coupling end with an inner portion either of the first or second component.

In accordance with the shown embodiment, the first component comprises the button-shaped end and the second component comprises the magazine stop end. According to different embodiments, the opposite can be provided.

Optionally, an appendix can be removably fastened directly on the first component, at the button-shaped end, thus providing suitable fastening means.

Independently from the provided embodiment, the coupling element may comprise a third component being at least partially inserted along the first and second components according to the longitudinal direction of the stop hook. This third component defines a constraint for the coupling portion which is either deformable or yielding. Advantageously, the coupling portion of the first component is internally hollow in order to accommodate the third component.

In accordance with a further embodiment, the first, second and third components provide an expansion coupling between the first and second components. Either the deformation or the yielding of the coupling portion can be caused by the same third component within the same coupling portion.

The coupling portion can be manufactured differently from what has been shown in order to provide a portion which is either elastically deformable or yielding.

The coupling between the stop end and the box can be different from what has been described and shown.

To the preferred embodiment of the stop hook for a magazine described above, those skilled in the art, aiming at satisfying contingent and specific needs, will be able to carry out several modifications, adjustments and replacements of elements with other elements being functionally equivalent thereto, without thereby departing from the scope of the following claims.

What is claimed is:

1. A reversible stop hook for a magazine of a gun adapted to be housed in the gun transversally to the magazine, said stop hook comprising a coupling element provided with a button-shaped end and with a stop end for preventing the withdrawal of the magazine from the gun, wherein said coupling element comprises at least a first component and a second component partially inserted one inside the other along a longitudinal direction of the stop hook and wherein at least said first component comprises a coupling portion comprising a longitudinal tongue which is either deformable or yielding and which fastens said first component to said second component at least along said longitudinal direction; wherein said first and second components together form a longitudinal through-hole that extends along the whole stop hook, thus opening to the outside of the stop hook at both ends.

2. A reversible stop hook for a magazine of a gun adapted to be housed in the gun transversally to the magazine, said stop hook comprising a coupling element provided with a button-shaped end and with a stop end for preventing the withdrawal from the magazine of the gun, wherein said coupling element comprises at least a first component and a second component partially inserted one inside the other along a longitudinal direction of the stop hook and wherein at least said first component comprises a coupling portion comprising a longitudinal tongue which is either deformable or yielding and which fastens said first component to said second component at least along said longitudinal direction and wherein said first and second components together form a longitudinal through-hole that extends along the whole stop hook, thus opening to the outside of the stop hook at both ends; wherein said coupling element further comprises a third component being inserted into said longitudinal through-hole in order to prevent the first and second components from mutually unfastening.

3. The reversible stop hook according to claim 2, wherein said third component comprises a head made integral with a peg extending along said longitudinal direction.

4. The reversible stop hook according to claim 3, wherein said head integrates into an end of said first or second component.

5. The reversible stop hook according to claim 3, wherein said peg internally passes through the first component and second component and comprises a coupling end with an appendix.

6. The reversible stop hook according to claim 5, wherein said appendix integrates into an end of said first or second component.

7. The reversible stop hook according to claim 3, wherein said peg internally passes through the first component and the second component and wherein an end which is opposite to said head does not open to the outside of the stop hook.

8. The reversible stop hook according to claim 7, wherein said peg comprises a coupling end for coupling with an inner portion of said first or second component.

9. A reversible stop hook for a magazine of a gun adapted to be housed in the gun transversally to the magazine, said stop hook comprising a coupling element provided with a button-shaped end and with a stop end for preventing the withdrawal of the magazine from the gun, wherein said coupling element comprises at least a first component and a second component partially inserted one inside the other along a longitudinal direction of the stop hook and wherein at least said first component comprises a coupling portion comprising a longitudinal tongue which is either deformable or yielding and which fastens said first component to said second component at least along said longitudinal direction and wherein said first and second components together form a longitudinal through-hole that extends along the whole stop hook, thus opening to the outside of the stop hook at both ends; wherein said coupling element comprises a third component at least partially inserted along the first and second components according to the longitudinal direction of the stop hook; and wherein longitudinal through-hole is internally hollow in order to accommodate said third component.

10. A kit for a gun comprising a reversible stop hook for a magazine of a gun adapted to be housed in the gun transversally to the magazine, said stop hook comprising a coupling element provided with a button-shaped end and with a stop end for preventing the withdrawal of the magazine from the gun, wherein said coupling element comprises at least a first component and a second component partially inserted one inside the other along a longitudinal direction of the stop hook and wherein at least said first component comprises a coupling portion comprising a longitudinal tongue which is either deformable or yielding and which fastens said first component to said second component at least along said longitudinal direction; wherein said first and second components together form a longitudinal through-hole that extends along the whole stop hook, thus opening to the outside of the stop hook at both ends;

said kit comprising at least one further button-shaped end adapted to replace the one of the stop hook, wherein said further button-shaped end is selected as a function of the shape and/or sizes and/or materials and/or surface finishing;

wherein said button-shaped end is made integral with said first component and wherein at least one further first component integrating said at least one further button-shaped end is provided.

11. A kit for a gun comprising a reversible stop hook for a magazine of a gun adapted to be housed in the gun transversally to the magazine, said stop hook comprising a coupling element provided with a button-shaped end and with a stop end for preventing the withdrawal of the magazine from the gun, wherein said coupling element comprises at least a first component and a second component partially inserted one inside the other along a longitudinal direction of the stop hook and wherein at least said first component comprises a coupling portion comprising a longitudinal tongue which is either deformable or yielding and which fastens said first component to said second component at least along said longitudinal direction; wherein said first and second components together form a longitudinal through-hole that extends along the whole stop hook, thus opening to the outside of the stop hook at both ends;

said kit comprising at least one further button-shaped end adapted to replace the one of the stop hook, wherein said further button-shaped end is selected as a function of the shape and/or sizes and/or materials and/or surface finishing;

wherein said button-shaped ends each comprises an appendix which is removable relative to said first component.

12. The kit for a gun according to claim 11, wherein each said button-shaped end comprises fastening means to fasten each said appendix to said first component.

13. The kit for a gun according to claim 11, wherein a third component of said stop hook comprises a coupling end to couple with each said appendix of each said button-shaped end.

14. The kit for a gun according to claim 11, wherein each said appendix of each said button-shaped end is a head of a third element of said stop hook.

15. A reversible stop hook for a magazine of a gun adapted to be housed in the gun transversally to the magazine, said stop hook comprising: a first component, a second component, and a third component, wherein said components are configured for preventing the withdrawal of the magazine from the gun;

a. said first component comprising a coupling portion having an inside surface, said coupling portion comprising a longitudinal tongue for insertion into the second component;

b. said second component comprising a housing having an inside surface for receiving the longitudinal tongue of the first component, wherein said first and second components together form a longitudinal through-hole that extends along the whole stop hook, thus opening to the outside of the stop hook at both ends; and c. said third component containing comprising a coupling end for insertion through said longitudinal through-hole, which prevents said first and second components from mutually unfastening.

16. The stop hook of claim 15, wherein the second component contains a stop end and a tooth, said tooth having a contact surface for securing the magazine within the gun.

17. The stop hook of claim 15, wherein the third component, when inserted into said longitudinal through-hole, generates a force against the inside surface of the coupling portion.

18. The stop hook of claim 17, wherein the first component, when inserted into the second component, generates a force against the inside surface of the second component.

19. The stop hook of claim 15, wherein the housing is substantially cylindrical.

20. The stop hook of claim 19, wherein the housing is cylindrical.

21. A reversible stop hook for a magazine of a gun adapted to be housed in the gun transversally to the magazine, said stop hook comprising:

a. a coupling element and a button-shaped end; wherein the coupling element and button-shaped end are physically separate parts designed to be removeably fastened to one another for preventing the withdrawal of the magazine from the gun;

b. said coupling element designed to receive the button-shaped end, wherein said coupling element comprises at least a first component and a second component partially inserted one inside the other along a longitudinal direction of the stop hook and wherein at least said first component comprises a coupling portion comprising a longitudinal tongue which is either deformable or yielding and which fastens said first component to said second component at least along said longitudinal direction and wherein said first component and second components together form a longitudinal through-hole that extends along the whole stop hook, thus opening to the outside of the stop hook at both ends; and c. said button-shaped end is removable from the first component, and comprises an extension to engage the first component.

22. The reversible stop hook according to claim 21, wherein said button-shaped end comprises a fastening means.

23. A reversible stop hook for a magazine of a gun adapted to be housed in the gun transversally to the magazine, said reversible stop hook comprising:

a. a first component which comprises a coupling portion which is either deformable or yielding and which snaps said first component to an inside surface of a second component, in order to prevent said first and second components from unfastening, wherein said first and second components are configured for preventing the withdrawal from the magazine of the gun and together form a longitudinal through-hole that extends along the whole stop hook, thus opening to the outside of the stop hook at both ends, and b. a third component which has a coupling end and which is disposed of in said longitudinal through-hole, in order to further prevent said first and second components from unfastening.

24. The reversible stop hook of claim 23, further comprising a button-shaped end with an appendix, wherein said appendix of said button-shaped end fastens with said coupling end of said third component.

* * * * *